US008863813B1

(12) United States Patent
Pagles

(10) Patent No.: US 8,863,813 B1
(45) Date of Patent: Oct. 21, 2014

(54) CORD RETRACTING SHADE OPERATING ASSEMBLY

(76) Inventor: Jonathan R. Pagles, Harvard, IL (US)

( * ) Notice: Subject to any disclaimer, the term of this patent is extended or adjusted under 35 U.S.C. 154(b) by 42 days.

(21) Appl. No.: 13/480,993

(22) Filed: May 25, 2012

Related U.S. Application Data

(63) Continuation-in-part of application No. 13/454,078, filed on Apr. 23, 2012, now abandoned.

(60) Provisional application No. 61/478,484, filed on Apr. 23, 2011.

(51) Int. Cl.
*E06B 9/38* (2006.01)

(52) U.S. Cl.
USPC ..... 160/173 R; 160/168.1 R

(58) Field of Classification Search
USPC ..... 160/170, 173 R, 178.1 R, 178.2, 84.04, 160/84.01, 193, 168.1, 171, 121.1
See application file for complete search history.

(56) References Cited

U.S. PATENT DOCUMENTS

| | | | | |
|---|---|---|---|---|
| 6,112,800 | A * | 9/2000 | Marusak | 160/298 |
| 7,487,817 | B2 * | 2/2009 | Liang | 160/170 |
| 7,984,745 | B2 * | 7/2011 | Wen et al. | 160/170 |
| 2004/0226663 | A1 * | 11/2004 | Smith et al. | 160/84.05 |
| 2004/0231803 | A1 * | 11/2004 | Cheng et al. | 160/84.04 |
| 2012/0305200 | A1 * | 12/2012 | Liu | 160/84.04 |

* cited by examiner

*Primary Examiner* — Blair M. Johnson
(74) *Attorney, Agent, or Firm* — Allen, Dyer, Doppelt, Milbrath & Gilchrist P.A.

(57) ABSTRACT

A shade operating assembly includes a mounting subassembly, and a lift cord subassembly and a lift cord retraction subassembly connected thereto. The lift cord subassembly includes at least one lift cord for effecting movement of a shade by movement of a first end of the at least one lift cord, and a lift cord locking device activatable to selectively engage the at least one lift cord and inhibit further movement thereof. The lift cord retraction subassembly includes a retractor cord engaging the at least one lift cord, and a cord retracting device retracting the retractor cord to retract the first end of the lift cord toward the mounting subassembly.

20 Claims, 6 Drawing Sheets

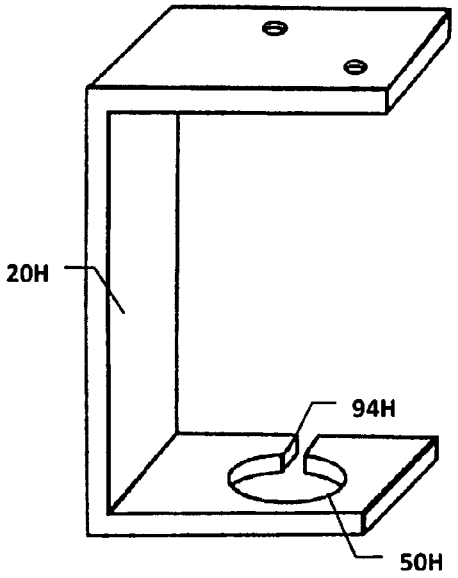
FIG. 16
FIG. 17
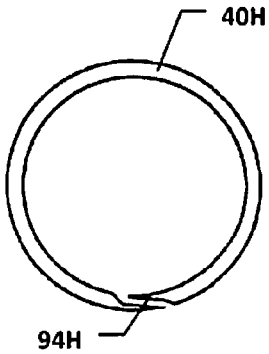

CORD RETRACTING SHADE OPERATING ASSEMBLY

CROSS-REFERENCE TO RELATED APPLICATIONS

This application is a continuation-in-part of U.S. Non-Provisional application Ser. No. 13/454,078, filed on Apr. 23, 2012, which claims the benefit of U.S. Provisional Application Ser. No. 61/478,484, filed on Apr. 23, 2011, the contents of which applications are herein incorporated by reference in their entirety.

FIELD OF THE INVENTION

The present invention relates to shades that are moved via cords, and more particularly, to devices and methods for reducing the amount of such cords that hang free when not in use.

BACKGROUND OF THE INVENTION

Cord-operated shades, such a roman shades or venetian blinds, are extremely common. For example, many homes will include multiple shades as window treatments, for both functional and aesthetic purposes. The cord operation of such shades, usually to raise or lower them, is a very convenient feature, and the cord mechanism usually incorporate a locking device that is activatable to inhibit further movement of the cord, maintaining the shade in a desired position.

One well known difficulty associated with such shades concerns the free length of cord hanging from the shade. For example, when a roman shade or mini-blind is raised, a considerable length of cord will ordinarily be hanging from the locking device. In addition to being unsightly, this free length of cord can present a safety hazard for children and pets. Various mechanisms have been put forward to address this problem with varying degrees of success. However, further improvements are possible.

SUMMARY OF THE INVENTION

In view of the foregoing, it is an object of the present invention to provide an improved shade operating assembly. According to an embodiment of the present invention, a shade operating assembly includes a mounting subassembly, and a lift cord subassembly and a lift cord retraction subassembly connected thereto. The lift cord subassembly includes at least one lift cord for effecting movement of a shade by movement of a first end of the at least one lift cord, and a lift cord locking device activatable to selectively engage the at least one lift cord and inhibit further movement thereof. The lift cord retraction subassembly includes a retractor cord engaging the at least one lift cord, and a cord retracting device retracting the retractor cord to retract the first end of the lift cord toward the mounting subassembly.

According to a method aspect, a method of reducing free lift cord length for a shade assembly includes engaging a lift cord with a retractor cord, and biasing the retractor cord in a retracted direction with a cord retracting device, such that, when the lift cord is not in use, the retractor cord retracts a free end of the lift cord upwardly.

The term "shade" is used herein to generically indicate a covering that is moveable by means of one or more cords. Non-limiting examples of shades include venetian blinds, pleated blinds, rolling blinds and roman shades. While shades are frequently employed as window treatments, the present invention is not necessarily limited with respect to the particular use of the shade.

These and other objects, aspects and advantages of the present invention will be better appreciated in view of the drawings and following detailed description of preferred embodiments.

BRIEF DESCRIPTION OF THE DRAWINGS

FIGS. 16 and 17 are schematic perspective views of a cord stop bracket and a cord collector, according to a further embodiment of the present invention.

DETAILED DESCRIPTION OF PREFERRED EMBODIMENTS

Figure 2:
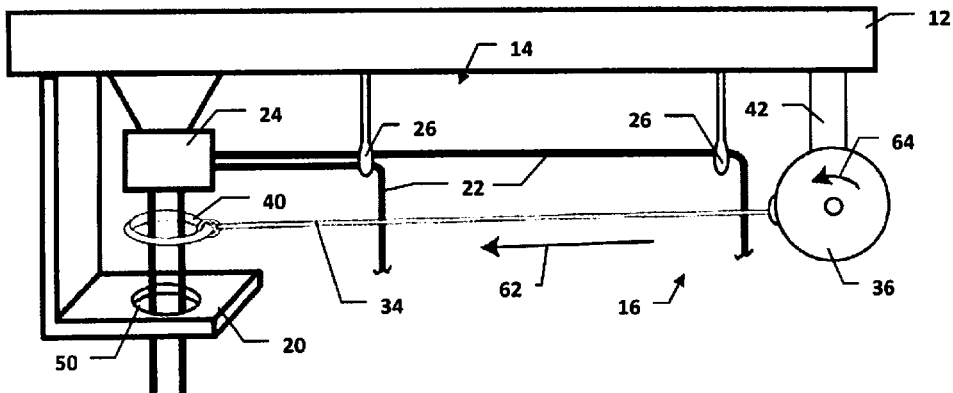
FIG. 2 is a schematic rear view of the assembly of FIG. 1, in an extended state.
Figure 1:
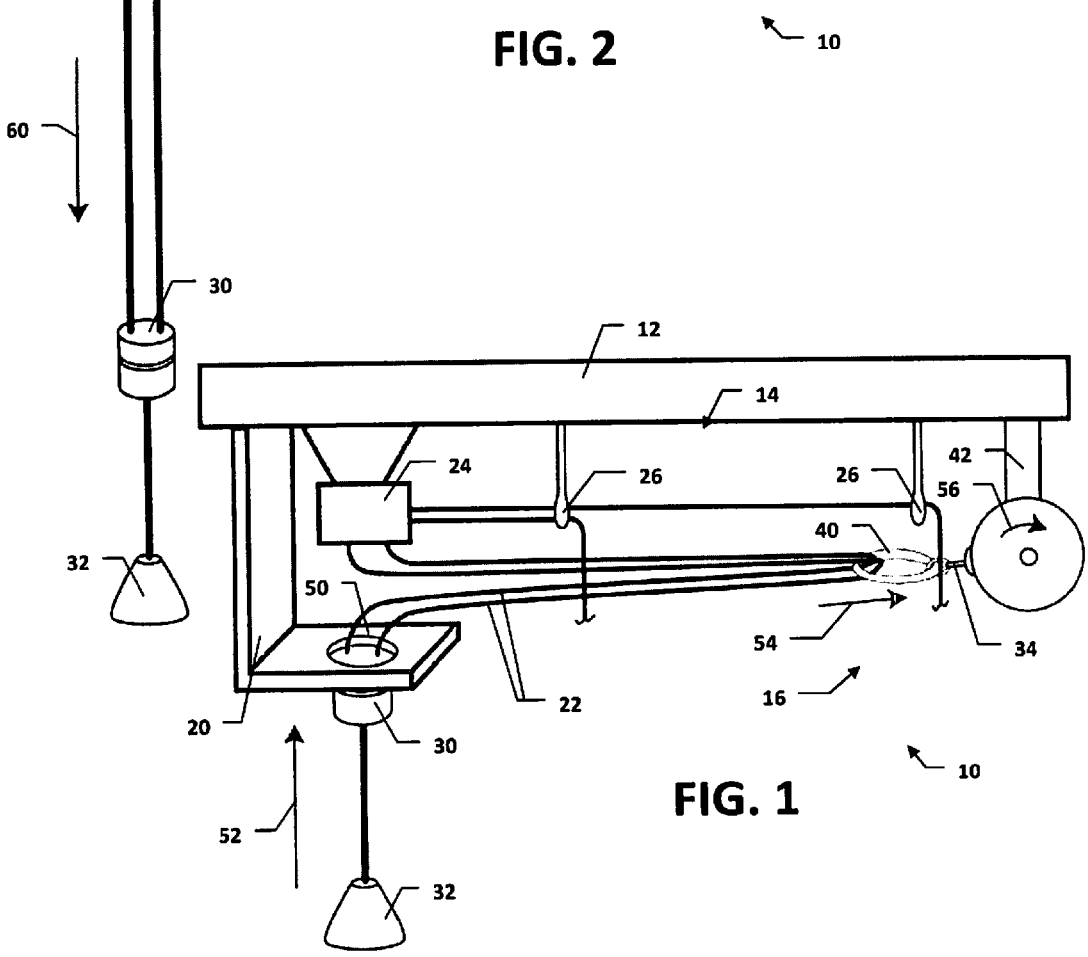
FIG. 1 is a schematic rear view of a shade operating assembly, including a mounting subassembly, a lift cord subassembly, a cord retraction subassembly and a cord stop bracket, according to an embodiment of the present invention, in a retracted state.

Referring to FIGS. 1 and 2, a shade operating assembly 10 includes a mounting subassembly 12, a lift cord subassembly 14, a cord retraction subassembly 16 and cord stop bracket 20. The mounting subassembly 12 holds the lift cord and cord retraction subassemblies 14, 16 and the cord stop bracket 20. The lift cord subassembly 14 is operable to move a shade and selectively lock the shade in a plurality of desired positions. The cord retraction subassembly 16 retracts the lift cord subassembly 14, as will be described in greater detail below, with the cord stop bracket 20 limiting retraction.

The mounting subassembly 12 can also support the shade being operated by the operating assembly 10, or the shade and the operating assembly 10 could use separate mounting components. Preferably, the mounting subassembly 12 includes a unitary head rail, although separate components could be used. In fact, in some embodiments, a window frame or other structural element could serve directly as a mounting subassembly.

The lift cord subassembly 14 includes one or more lift cords 22, a cord locking device 24, eyelets 26, a cord stop 30 and a cord pull 32. Movement of the lift cords 22 will effect movement of the shade, with free ends of the lift cords 22 being retracted toward the mounting subassembly 12 by the cord retraction subassembly 16. The "free end" of a lift cord, as used herein, is the end which is extendable below the locking device 24.

The cord locking device 24 selectively restricts movement of the lift cords 22, allowing the shade to be secured in a desired position. Routing of the lift cord from the locking device 24 is performed by the eyelets 26 and/or pulleys or other cord guide structure. Interference between the cord stop 30 and the cord stop bracket 20 limits the retraction of the lift cords 22 by the cord retraction subassembly 16. Where multiple lift cords 22 extend from the cord locking device 24, the cord stop 30 is advantageously also a cord condenser, with only a single cord extending therefrom. The cord pull 32 facilitates grasping of the lift cord subassembly.

The cord retraction subassembly 16 includes a retractor cord 34, a cord retracting device 36, a cord collector 40 and retracting device mounting bracket 42. The retractor cord 34 engages the lift cords 22 with the cord collector 40. Advantageously, the cord collector 40 is a ring surrounding the lift cords 22. Alternately, an end of the retractor cord 34 could be looped around the lift cords 22. The cord retracting device 36, supported by the mounting bracket 42, retracts the retractor cord 34, which in turn retracts the lift cords 22. Preferably, the cord retracting device 36 is automatic winding cord reel.

Figure 3:
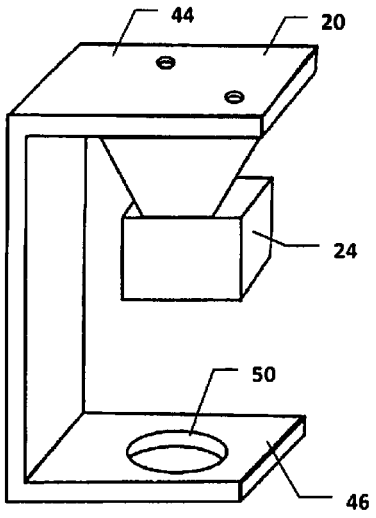
FIG. 3 is a perspective view of the cord stop bracket of FIG. 1.

The cord stop bracket 20 (best seen in FIG. 3) is a C-shaped element with an upper limb 44 and a lower limb 46. Advantageously, the cord locking device 24 is attached to the upper limb 44 and a lift cord opening 50 defined in the lower limb 46. Referring again to FIGS. 1 and 2, free ends of the lift cords 22 are routed through the lift cord opening 50. The cord stop 32 has a larger diameter than the lift cord opening 50, such that the cord stop 32 will not pass therethrough.

In operation, when the lift cords 22 are not being pulled, free ends of the lift cords 22 are retracted (as in FIG. 1) by engagement with the retractor cord 34, which is pulled into the cord retracting device 36. Preferably, the retracted lift cord lengths are drawn into an area behind an upper portion of the shade or within a header, where they are hidden from view together with most of the operating system 10. In a typical mounting orientation, the retracted portion of the lift cords are drawn to the side resulting in an overall upward movement of the free ends. Movements of the free ends of the lift cords 22, the retractor cord 34 and the cord retracting device 36 are indicated by arrows 52, 54, 56, respectively.

When the lift cords 22 are pulled (as in FIG. 2), the force of the pulling overcomes the force exerted by the cord retracting device 36, the free ends lower and the lift cords 22 straighten. The cord locking device 24 can be disengaged with the straightened lift cords 22 and the shade re-positioned. Movements of the free ends of the lift cords 22, the retractor cord 34 and the cord retracting device 36 are indicated by arrows 60, 62, 64, respectively. Once the lift cords 22 are released, retraction will automatically as generally indicated in FIG. 1.

Figure 4:
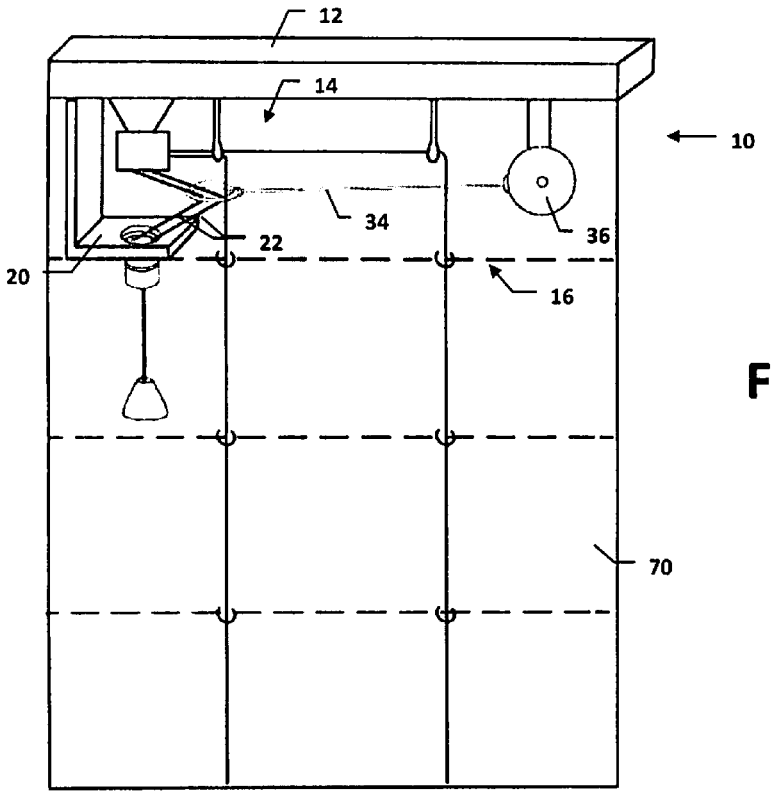
FIG. 4 is a schematic rear view of the shade operating assembly of FIG. 1, in use with a lowered shade.
Figure 5:
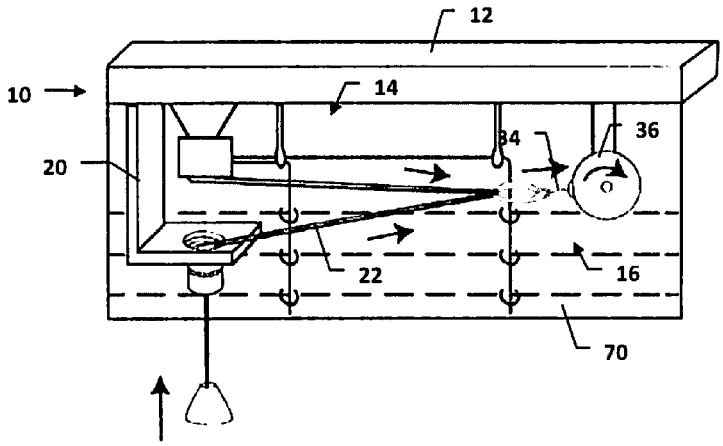
FIG. 5 is a schematic rear view of the shade operating assembly of FIG. 1, in use with a raised shade.

As will be appreciated from FIGS. 4 and 5, in which the shade operating assembly 10 is shown in connection with a shade 70, retraction of the lift cords 22 occurs independently of the position of the shade 70. In FIG. 4, the shade 70 is fully lowered, so only a relatively short length of the lift cords 22 is free for retracting. In FIG. 5, the shade 70 is fully raised, and a greater length of the lift cords 22 is retracted. The position of the cord retracting device 36 and the extended length of the retractor cord 34 are preferably selected to accommodate the different degrees of retraction required over the full range of shade 70 positions.

Figure 6:
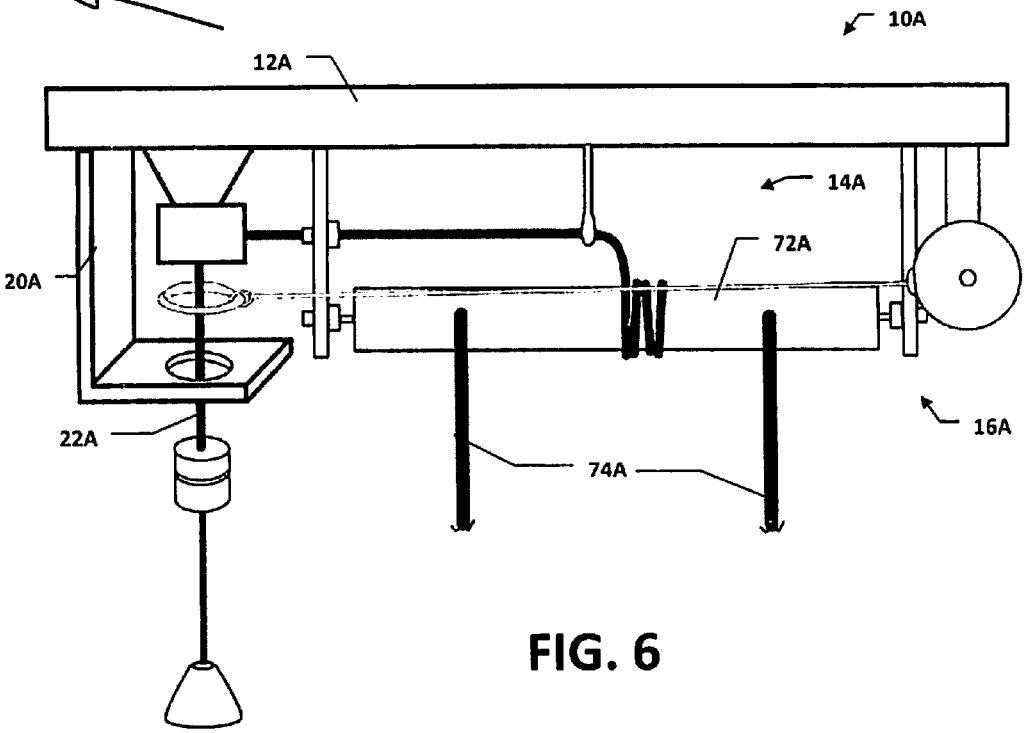
FIG. 6 is a schematic rear view of a shade operating assembly, according to another embodiment of the present invention.

The foregoing embodiment is provided for exemplary and illustrative purposes; the present invention is not necessarily limited thereto. For example, in the foregoing embodiment, the lift cords 22 being retracted attach directly to the shade 70. Referring to FIG. 6, the present invention is equally applicable to a shade operating assembly 10A having a lift cord subassembly 14A where a lift cord 22A attaches to a roller 72A or like intermediate structure. Operation of the lift cord 22A will wind or unwind supplemental lift cords 74A from the roller 72A to move a shade. The lift cord described above in connection with the shade operating assembly 10. Also lift cord subassemblies employing wands could be used.

Figure 7:
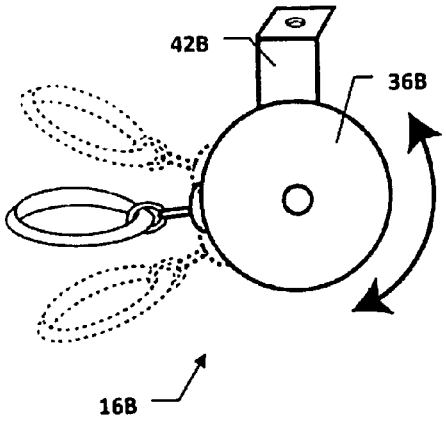
FIG. 7 is a schematic rear view of a cord retraction assembly, according to a further embodiment of the present invention.
Figure 8:
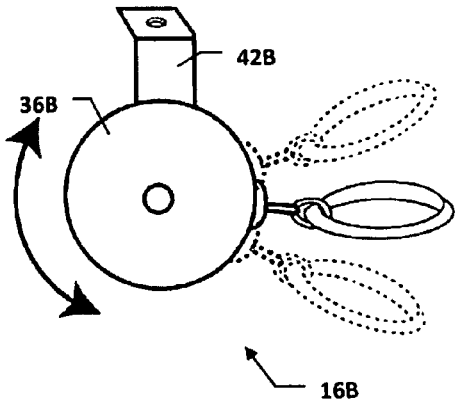
FIG. 8 is another schematic rear view of the cord retraction assembly of FIG. 7, in an alternate position.
Figure 9:
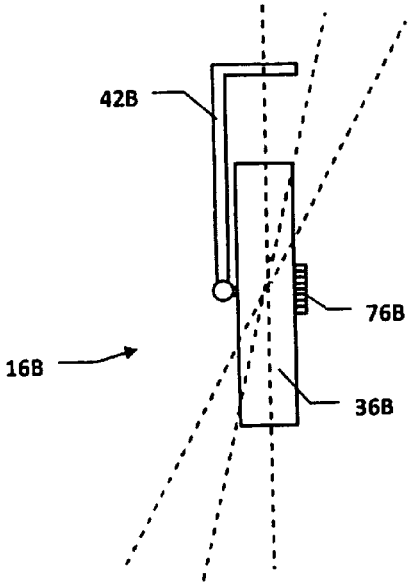
FIG. 9 is a schematic side view of the cord retraction assembly of FIG. 7.

In another example, a cord retracting device 36B can be pivotably mounted to a retaining device mounting bracket 42B so as to be pivotable about an axes parallel with (FIGS. 7 and 8) and perpendicular to (FIG. 9) a retractor cord winding axis. This pivotability can allow greater flexibility of use of a single design of a cord retraction subassembly 16B within different shade operating assemblies. Additionally, the cord retracting device 36B can be equipped with a tension adjustment 76B, to adjust the speed and force of retraction.

Figure 11:
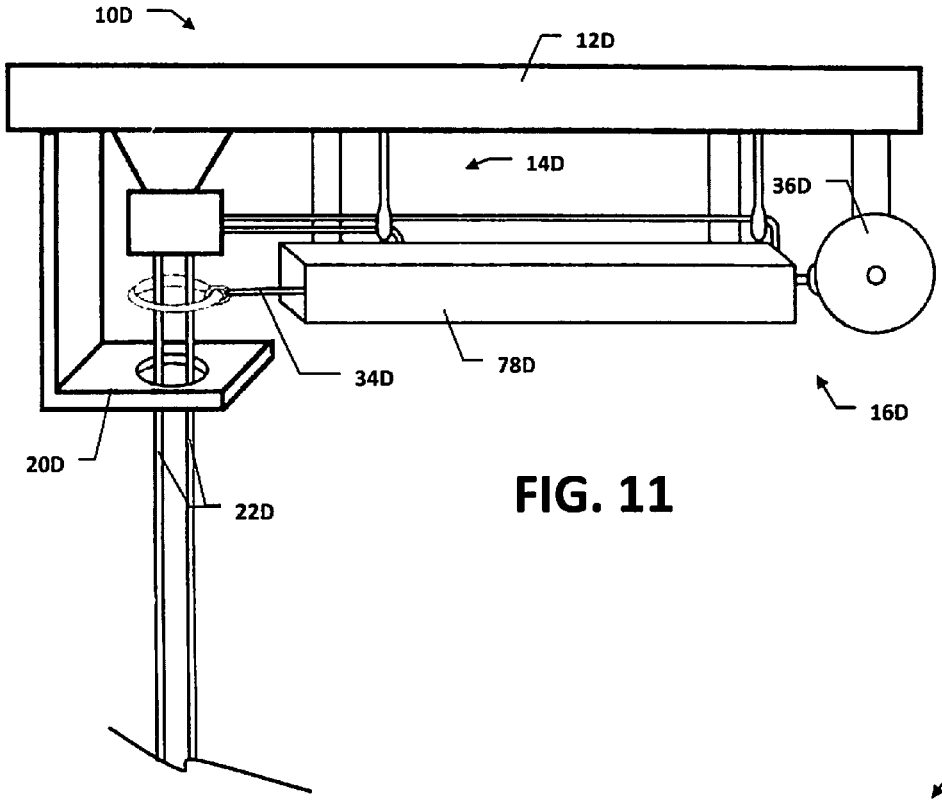
FIG. 11 is a schematic rear view of a shade operating assembly, according to another embodiment of the present invention.
Figure 10:
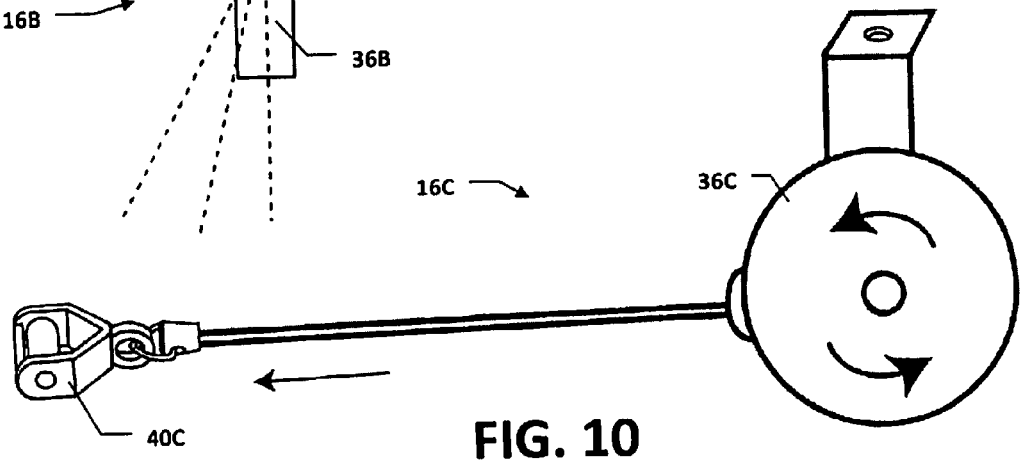
FIG. 10 is a schematic rear view of a cord retraction assembly, according to an additional embodiment of the present invention.

Also, referring to FIG. 10, rather than the ring-shaped cord collector 16, a cord retraction assembly 16C could include a cord collector 40C incorporating a pulley. Referring to FIG. 11, a cord retraction assembly 16D incorporates a retractor cord enclosure 78D through which the retractor cord 34D passes between the cord retracting device 36D and the lift cords 22D.

Figure 12:
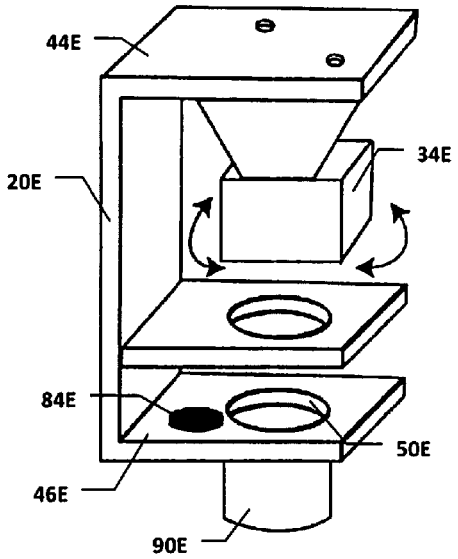
FIGS. 12 and 13 are schematic perspective views of a cord stop bracket and a cord stop, according to a further embodiment of the present invention.
Figure 13:
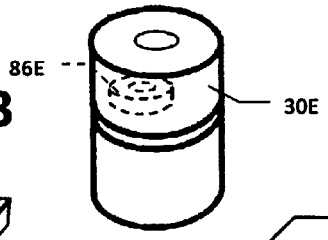

Referring to FIG. 12, in an alternate cord stop bracket 20E, another lift cord opening 80E is defined in a middle limb 82E, aligned with the lift cord opening 50E. The cord collector engages the lift cord between these openings to prevent interference between the cord collector and the cord locking device 24E. To enhance operability of the cord locking device 24E, it can be pivotably mounted to the cord stop bracket 20E. To increase the initial pull required to straighten the lift cord, a magnet 84E can be arranged on the stop bracket 20E that is attracted to another magnet 86E in the cord stop 30E (FIG. 13). To improve lift cord routing, a cord guide 90E can extend downwardly from around the lift cord opening 50E.

Figure 14:
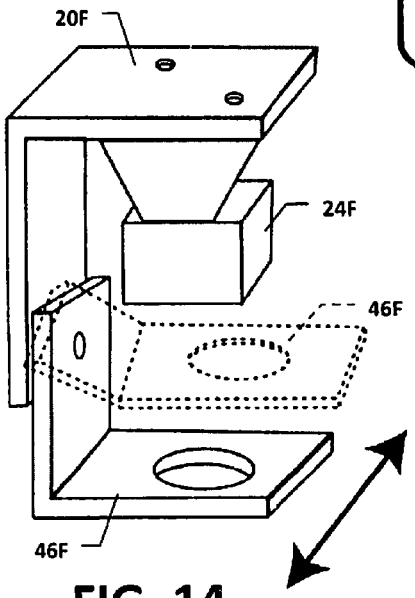
FIG. 14 is a schematic perspective view of a cord stop bracket, according to an additional embodiment of the present invention.
Figure 15:
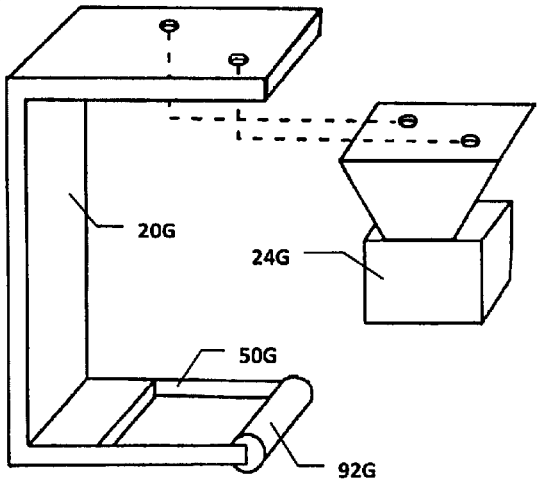
FIG. 15 is a schematic perspective view of a cord stop bracket, according to another embodiment of the present invention.

In another cord stop bracket 20F (FIG. 14), the lower limb 46F can be pivotable for greater flexibility where the lift cord needs to tend downward at a sharper angle from the cord locking device 24F. In the stop bracket 20G (FIG. 15), cord routing is improved by defining an edge of the lift cord opening 50G with a roller 92G.

Additionally, functional of advantages of the present invention can be readily achieved in existing shades by retrofitting components into shade operating systems thereof. For example, with reference to FIGS. 1 and 2, if a shade already has a shade operating system with a lift cord subassembly like the lift cord subassembly 14, the shade operating system can be made to retract by retrofitting in the cord retraction subassembly 10 and the stop bracket 20, and if necessary, a cord stop 30. To ensure proper alignment the cord locking device 24 can be secured to the stop bracket 20 above the lift cord opening (see also FIG. 15).

System components can be modified to facilitate this retrofitting. For instance, referring to FIGS. 16 and 17, lift cord access slots 94H are defined in the cord stop bracket 20H and the cord collector 94H. The lift cord access slots 94H allow the lift cord or cords to readily inserted into the lift cord opening 50H of the bracket 20H and into the cord collector 94H from sides thereof without the need to de-cord the existing shade being retrofitted.

The foregoing are not intended to be an exhaustive list of modifications to the present invention. Rather, those skilled in the art will appreciate that these and other modification, as well as adaptations to particular circumstances, will fall within the scope of the invention as shown and described, and of the claims appended hereto.

What is claimed is:

1. A shade operating assembly comprising:

a mounting subassembly;

a lift cord subassembly connected to the mounting subassembly including:

at least one lift cord for effecting movement of a shade by movement of a first end of the at least one lift cord; and a lift cord locking device activatable to selectively engage the at least one lift cord and inhibit further movement thereof; and a lift cord retraction subassembly connected to the mounting subassembly including:

a retractor cord engaging the at least one lift cord; and a cord retracting device retracting the retractor cord to retract the first end of the lift cord toward the mounting subassembly.

2. The shade operating assembly of claim 1, wherein the mounting assembly includes a head rail to which the lift cord subassembly and the lift cord retraction subassembly are commonly mounted.

3. The shade operating assembly of claim 1, wherein a second end of the at least one lift cord is attached directly to the shade.

4. The shade operating assembly of claim 1, wherein the lift cord subassembly further includes a lift roller and at least one secondary lift cord, the at least one lift cord being attached to the roller and the at least one secondary lift cord, the at least one secondary lift cord being attachable to the shade.

5. The shade operating assembly of claim 1, wherein the lift cord subassembly further includes at least one eyelet, the at least one lift cord being routed through the at least one eyelet.

6. The shade operating assembly of claim 1, further comprising a cord stop bracket, the cord stop bracket defining a first lift cord opening through which the first end of the at least one lift cord passes, the cord stop bracket limiting the retraction of the first end of the at least one lift cord by the lift cord retraction subassembly.

7. The shade operating assembly of claim 6, wherein the lift cord subassembly includes a cord stop attached proximate to the first of the at least one lift cord, engagement between the cord stop and the cord stop bracket limiting the retraction of the at least one lift cord.

8. The shade operating assembly of claim 7, wherein the lift cord subassembly includes at least one additional lift cord for effecting movement of a shade by movement of a first end of the at least one additional lift cord, the first end of the at least one additional lift cord also passing through the first lift cord opening of the cord stop bracket, the cord stop also being attached proximate to the first end of the at least one additional lift cord such that the cord stop also functions as a lift cord condenser.

9. The shade opening assembly of claim 7, wherein the cord stop bracket and the cord stop each include a magnet, the magnets of the cord stop bracket and the cord stop being arranged to attract each other.

10. The shade opening assembly of claim 6, wherein the cord stop bracket further defines a lift cord access slot extending from the first lift cord opening to an edge of the cord stop bracket such that the at least one lift cord can be inserted therethrough.

11. The shade opening assembly of claim 6, wherein the cord stop bracket defines a second lift cord opening aligned with the first lift cord opening, the first end of the at least one lift cord also passing through the second lift cord opening, the retractor cord engaging the at least one lift cord between the first and second lift cord openings.

12. The shade opening assembly of claim 6, wherein the cord stop bracket includes C-shaped element with upper and lower limbs, the lift cord locking device being attached to the upper limb and the first lift cord opening being defined in the lower limb.

13. The shade opening assembly of claim 1, wherein the lift cord retraction subassembly further includes a cord collector surrounding the at least one lift cord.

14. The shade opening assembly of claim 13, wherein the cord collector includes a collector ring surrounding the at least one lift cord.

15. The shade opening assembly of claim 14, wherein the collector ring defines a lift cord access slot extending through a portion thereof such that the at least one lift cord can be inserted therethrough.

16. The shade opening assembly of claim 1, wherein the cord retracting device includes an automatic winding cord reel for the retractor cord.

17. The shade opening assembly of claim 16, wherein the lift cord retraction subassembly further includes a retracting device mounting bracket mounting the cord reel.

18. The shade opening assembly of claim 17, wherein the cord reel is pivotably mounted to the retracting device mounting bracket about an axis parallel to a cord winding axis of the cord reel.

19. The shade opening assembly of claim 17, wherein the cord reel is pivotably mounted to the retracting device mounting bracket about an axis perpendicular to a cord winding axis of the cord reel.

20. The shade opening assembly of claim 1, wherein the lift cord retraction subassembly further includes a retractor cord enclosure through which the retractor cord passes between the cord retracting device and the at least one lift cord.

* * * * *